US006105295A

United States Patent [19]

Brinkman et al.

[11] Patent Number: 6,105,295

[45] Date of Patent: Aug. 22, 2000

[54] LABEL HOLDER FOR ATTACHMENT TO DIFFERENT SHELF CHANNELS

[75] Inventors: Michael Brinkman, Phoenix, Ariz.; Harvey Brandon, Coral Springs, Fla.

[73] Assignee: Fast Industries, Ltd., Fort Lauderdale, Fla.

[21] Appl. No.: 09/075,522

[22] Filed: May 11, 1998

[51] Int. Cl.[7] ..... G09F 3/18

[52] U.S. Cl. ..... 40/661.03; 40/649; 40/658; 40/666; 248/214; 248/231.81

[58] Field of Search ..... 40/642.01, 642.02, 40/649, 651, 658, 661.03, 661.08, 666; 211/57.1, 59.1; 248/214, 223.41, 224.51, 231.81

[56] References Cited

U.S. PATENT DOCUMENTS

| | | | |
|---|---|---|---|
| 1,704,562 | 3/1929 | Egan . | |
| 2,206,522 | 7/1940 | Varon . | |
| 2,827,718 | 3/1958 | Howard . | |
| 2,856,711 | 10/1958 | Hobbs | 40/651 |
| 3,084,463 | 4/1963 | Guyer et al. | 40/658 X |
| 4,295,288 | 10/1981 | Westberg . | |
| 4,426,797 | 1/1984 | Burkemper et al. . | |
| 4,674,721 | 6/1987 | Thalenfeld | 211/59.1 X |
| 4,821,437 | 4/1989 | Abramson et al. | 40/651 X |
| 4,866,868 | 9/1989 | Kass . | |
| 5,044,104 | 9/1991 | Hopperdietzel . | |
| 5,197,215 | 3/1993 | Torsleff . | |
| 5,263,269 | 11/1993 | Tjarnlund . | |
| 5,419,066 | 5/1995 | Harnois et al. . | |
| 5,456,034 | 10/1995 | Lewis et al. . | |
| 5,473,833 | 12/1995 | Ostrovsky . | |
| 5,488,793 | 2/1996 | Gebka et al. . | |
| 5,509,634 | 4/1996 | Gebka et al. . | |
| 5,515,632 | 5/1996 | Gebka et al. . | |
| 5,572,822 | 11/1996 | Lynch et al. . | |
| 5,577,337 | 11/1996 | Lin . | |
| 5,682,698 | 11/1997 | Bevins . | |
| 5,720,398 | 2/1998 | Kump et al. . | |
| 5,799,427 | 9/1998 | Abramson et al. | 40/642.02 |
| 5,899,011 | 5/1999 | Brinkman | 40/661.03 |

FOREIGN PATENT DOCUMENTS

| | | |
|---|---|---|
| 0429400 | 11/1990 | European Pat. Off. . |
| 0429400 | 5/1991 | European Pat. Off. . |
| 3804894 | 8/1989 | Germany . |

OTHER PUBLICATIONS

EZ–View Label Placement & Merchandising Systems, Catalog—vol. 1.

EZ–View Retail Label Holders and Sign Holders, Catalog, vol. 2.

EZ–View Nonadhesive Label Applications Instruction Manual.

*Primary Examiner*—Terry Lee Melius
*Assistant Examiner*—Andrea Chop
*Attorney, Agent, or Firm*—Jacobson, Price, Holman & Stern, PLLC

[57] ABSTRACT

A label holder for displaying information-containing non-adhesive labels or signs on a channel member at the front of a variety of forms of merchandise shelves in a supermarket or the like, particularly adapted for secure support and ready attachment to both Streator and Lozier type shelf systems wherein the height and configuration of the channel members are different. The label holder may be a co-extrusion of an opaque body panel and a transparent cover resiliently connected along their lower edges to define a label-receiving pocket therebetween. An upwardly and rearwardly extending leg member is integral with the rear of the body panel and underlies and extends behind the channel member. A lower finger is also carried by the rear of the body panel and is biasingly engaged with the upper surface of the lower flange of the channel member. An upper finger is provided on the upper edge of the body panel and is biasingly engaged with the lower surface of the upper flange of the channel member. The upper finger can be collapsed to permit the label holder to be readily engaged within the more closely spaced and prominently defined flanges or lips forming a C-channel on Lozier-type shelves, while expanding to securely engage the label holder between the more widely spaced and less distinctive flanges of Streator-type shelves.

7 Claims, 4 Drawing Sheets

LABEL HOLDER FOR ATTACHMENT TO DIFFERENT SHELF CHANNELS

This invention relates to label holders for displaying information-containing labels or the like on a channel member at the front of a merchandise shelf, and relates more particularly to a versatile plastic label holder adapted to be removably engaged with channels formed on the front of different types of shelving currently in use.

BACKGROUND OF THE INVENTION

Tags, labels or signs are commonly provided at the front of steel merchandise-containing shelves in supermarkets and the like to present bar codes or other inventory control information to the store employees and/or to present pricing, announce sales or provide other information regarding the products displayed on the shelves to the customer. Adhesive-backed labels can be affixed directly to the front surface of the shelf. While adhesive-backed labels may be secured to surfaces of varying dimensions, they are difficult to remove or replace when different merchandise is to be displayed on the shelf, and generally leave behind an unsightly adhesive residue. The cost of such labels is not only higher because of the adhesive, the labor costs associated with removing and replacing such labels significantly increases the overall expense of such systems.

Non-adhesive labels are less expensive to manufacture; additionally, they can generally be installed and removed much more readily. For that purpose, most merchandise shelves include a generally C-shaped price channel along the front edge with upper and lower forwardly-directed flanges or lips adapted to accommodate snap-in labels or label or sign holders designed to receive and display non-adhesive paper or plastic labels or signs containing inventory, pricing or other such information or data. The appearance of shelving provided with label holders adapted to removably receive non-adhesive labels is dramatically improved and the cost of providing such merchandise information is reduced.

Depending upon the type of shelving, the price channel configuration may be different. Although the size of most price channels is similar, no two shelves are exactly alike. Thus, the height of the channel formed between the upper and lower flange members may vary because of manufacturing tolerances, even on different shelves of the same shelf system. Moreover, the configuration of the front edge portions of shelving provided by different manufacturers may vary significantly. While many merchandise shelves currently manufactured for the U.S. market have prominent C-channels defined in their front edge by downwardly turned upper lips and upwardly turned lower lips, the pockets formed by the upper and lower flanges on the shelf front edge of some older shelving still in common use are not so distinct, either or both flanges being more perpendicular to the shelf edge. The former design is typified by the "Lozier" shelf and the latter design by the "Streator" shelf.

Various attachments are currently on the market for adapting a C-channel to removably receive and display non-adhesive information-containing labels to a consumer. In most versions, one or more rearwardly extending flexible legs are provided with portions designed to snap into the upper and lower flanges of the C-channel. While such attachments may provide only upper and lower channels to receive and retain a paper or plastic label, much like the C-channel on the shelf, they commonly include a main body or backing panel and a hingedly attached transparent cover which together define a pocket between them for reception of a non-adhesive label or sign or sign holder. In some circumstances, a transparent label cover can be snapped directly onto a C-channel over the lower edge, providing a pocket for a non-adhesive label between the cover and the C-channel itself.

While each of the foregoing systems are useful, they each have limited application and one or more disadvantages. For example, while the label holders with rearwardly extending legs can accommodate C-channels of somewhat varying dimensions, they are generally designed to fit between the upper and lower flange elements of a particular shelving system and have little versatility.

The snap-on covers rely heavily on their ability to mount on and pivot about the lower edge of a price channel placing great stress on the connection, particularly if the design of the shelf is somewhat unusual or if the lower edge of the channel is bent. Moreover, since the covers must be transparent in order for the information on the label to be viewed therethrough, any unsightly portion of the C-channel not hidden by a label is visible to passersby.

A label holder for attachment to price channels which does not rely primarily on engagement with the merchandise shelf channel flanges for support is disclosed in copending U.S. patent application Ser. No. 08/841,680 filed Apr. 30, 1997, the subject matter of which is incorporated herein in its entirety. While this system provides more versatility, the attachment to the shelf is somewhat less secure, limiting its potential.

Thus, while some of the prior art label holders can solve certain of the problems associated with devices of this type, label holders that can be securely fitted to, but readily removed from, shelves having front faces or C-channels of slightly different height or configuration, particularly label holders adapted to accommodate both the different height and the different configuration of the Lozier and Streator-type shelf systems, are not currently available. A particular problem with prior art attempts to provide a more universal or versatile construction, is the difficulty in facilitating the attachment and the removal of such label holders within the tight fit afforded by the more closely spaced and prominent pockets formed between the upper and lower lips on a Lozier shelf, while insuring that such label holders are not inadvertently dislodged from engagement with the less distinctive and more widely spaced channels formed on the front face of a Streator shelf, particularly when the transparent cover is pulled forwardly to insert or remove a non-adhesive label or sign in the label holder pocket.

SUMMARY OF THE INVENTION

It is the primary object of the instant invention to provide a label holder for displaying information-containing non-adhesive labels or signs on a channel member at the front of a merchandise shelf which overcomes the foregoing and other disadvantages attendant to prior art devices currently available.

Another object of this invention is the provision of a label holder which can accommodate greater variation in the configuration and dimensions of a channel member to which it is attached.

Yet a further object of this invention is the provision of a plastic label holder which includes a resilient, rearwardly and upwardly extending leg member at the bottom of the main body panel which, together with the back of the body panel, defines an enlarged pocket engaged loosely about the lower edge and flange of a merchandise shelf channel member, with a pair of opposed fingers on the back of the body panel adapted to engage in the upper and lower flanges on the channel member, the upper finger being flexibly attached to the top of the main body panel and angularly offset so as to readily bend or collapse, thereby affording a secure engagement with a Streator-type shelf channel, while readily accommodating a Lozier-type shelf channel.

Another object of this invention is the provision of a label holder which covers the lower flange and is provided with an upwardly and rearwardly extending lip member carried by its upper edge portions for engagement with the upper flange of a merchandise shelf channel member, filling any space between the label holder and the upper and lower flanges of the channel member, thereby precluding dirt from getting between these elements while acting to secure the label holder to the channel member.

A still further object of this invention is the provision of a label holder having the foregoing advantages and which may be a co-extrusion of an opaque body panel with a transparent plastic cover member hingedly secured to the bottom thereof to define therebetween a pocket for reception of non-adhesive labels or the like, the opaque body panel spanning and visually blocking the merchandise shelf channel member to hide from view any old adhesive price tags or unsightly residue on the channel member.

Still other objects and advantages of the instant inventive concepts will be apparent to those skilled in the art from the ensuing description of the preferred embodiments and claims read in conjunction with the attached drawings.

BRIEF DESCRIPTION OF THE DRAWINGS

Like characters refer to like parts throughout the several views of the drawings.

DETAILED DESCRIPTION OF THE PREFERRED EMBODIMENTS

Figure 1:
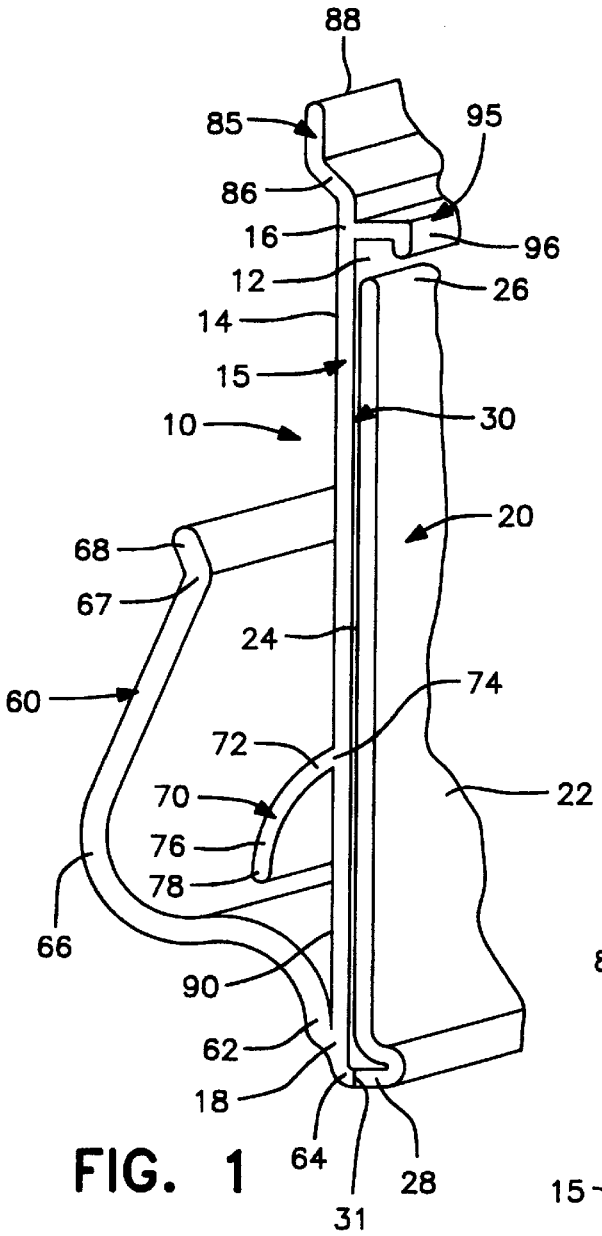
FIG. 1 is a fragmentary perspective view of a label holder according to the instant inventive concepts.
Figure 2:
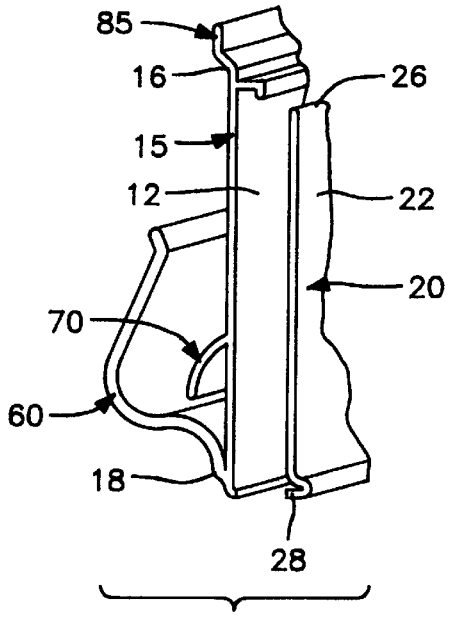
FIG. 2 is a reduced size exploded view of the label holder of FIG. 1 illustrating the co-extruded portions thereof in spaced-apart relationship.

Referring now to the drawings in general, and particularly to FIGS. 1 and 2, a preferred label holder according to the instant inventive concepts is designated generally by the reference numeral 10, and comprises basically a generally planar opaque main body panel 15, and a generally planar transparent cover 20. The body panel 15 has a front surface 12, a rear surface 14, an upper edge 16 and a lower edge 18. The cover 20 has a front surface 22, a rear surface 24, an upper edge 26 and a lower edge 28.

As seen in FIG. 2, the body panel 15 and the cover 20 are the result of a co-extrusion, the former being formed, preferably, of an opaque, perhaps colored, polyvinyl chloride, and the latter preferably being formed of a transparent polyvinyl chloride, to enable a non-adhesive paper or plastic label 25 (see FIG. 6) to be received in the pocket 30 formed between the body panel 15 and the cover 20, and viewed through the transparent cover 20 for scanning bar codes or the like or for visually observing printed information contained thereon, or to allow downwardly depending reverted flange portions 27 of an enlarged sign or sign holder 29 (see FIG. 7) to be engaged in the pocket 30 as discussed in more detail below.

The co-extrusion process is well known, and the lower edges 18, 28 of the body panel 15 and the cover 20 are integrally joined at 31 to provide a flexible interconnection, biasing the cover 20 toward the position shown in FIG. 1, but permitting the cover to be bent outwardly from the body panel for insertion and removal of non-adhesive labels or signs into and from the pocket 30.

Although the two-part construction shown in the drawings is preferred for most applications, the cover 20 could be deleted and the body panel 15 provided with upper and lower lips (not shown) to defined thereby more simplified means for holding a non-adhesive label or the like.

Figure 3:
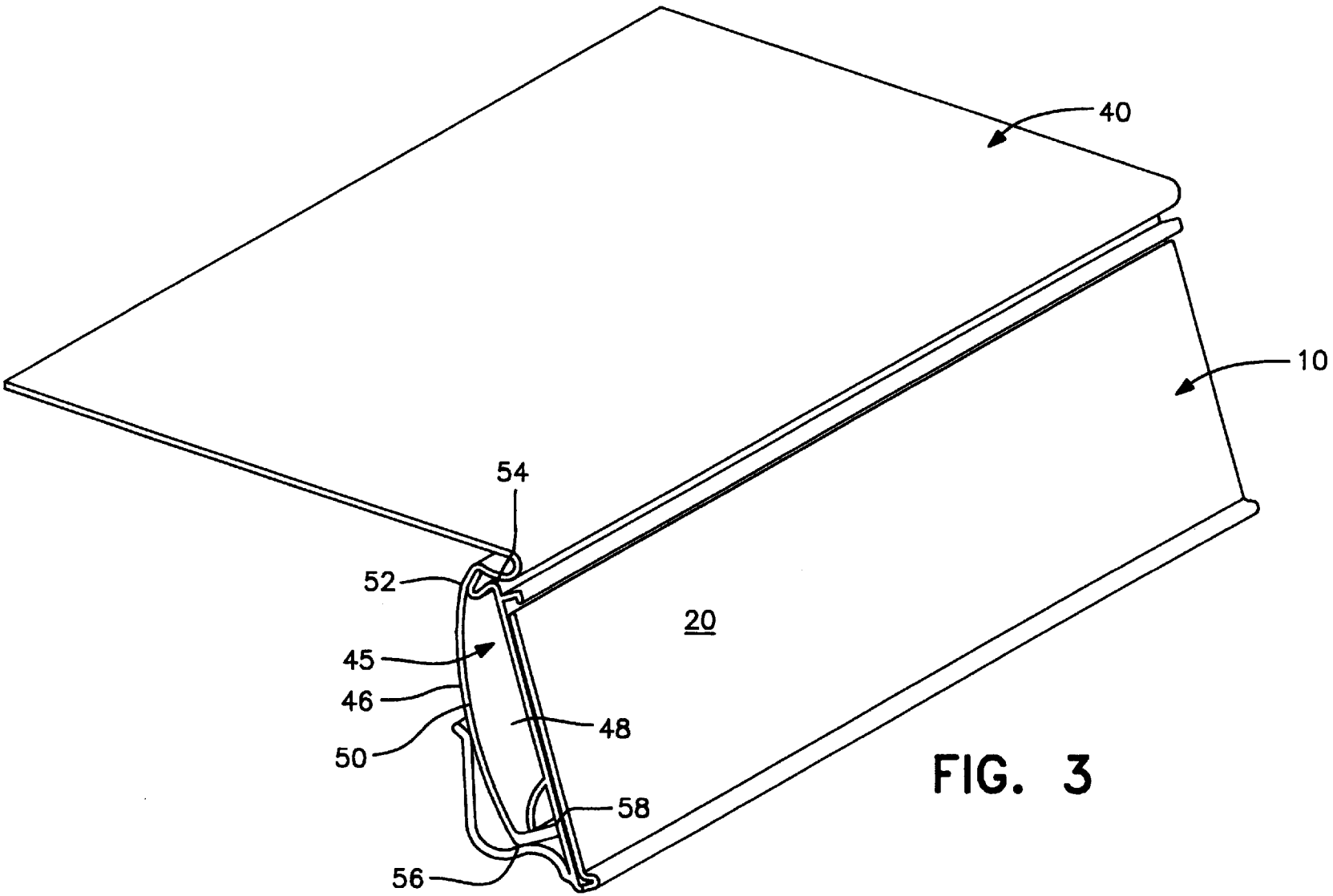
FIG. 3 is a perspective view of the label holder of FIG. 1 secured in place on a C-channel at the front of a merchandise shelf.

The label holder 10 is adapted to be removably secured to a merchandise shelf shown generically at 40 in FIG. 3 having a channel member, such as a C-channel or the like 45, formed along its front edge. The channel member 45 commonly includes an elongated central portion 46, generally arcuate in form, having a front surface 48 and a rear surface 50, and terminating in an upper edge 52 including a forwardly extending upper flange 54, and a lower edge 56 including a forwardly extending lower flange 58.

The specific details of the merchandise shelf or the channel member on the front edge thereof are not part of the instant inventive concepts, except to the extent that they generally include the elements identified above which are adapted to cooperate with a label holder according to this invention. Of some importance, however, is that the label holder 10 of this invention is versatile and designed to be used with shelf systems have channel members of different heights and configurations.

As noted above, two types of shelves currently in use are the Streator shelf and the Lozier shelf. The manner in which the label holder 10 of this invention is uniquely adapted to cooperate with both of these styles of shelving will be discussed in more detail below, with particular reference to FIG. 4, which illustrates a Streator-type shelf 40*a,* wherein parts similar to those of the generic shelf 40 of FIG. 3 are identified by the same reference numerals followed by the suffix "a", and FIG. 5, which illustrates a Lozier-type shelf 40*b,* wherein parts similar to those of the generic shelf 40 of FIG. 3 are identified by the same reference numerals followed by the suffix "b".

In order to enable the label holder 10 to be removably secured to the channel member 45*a* or 45*b* without critical consideration of the configuration or dimensions of the channel member, the body panel 15 is provided with a resilient, rearwardly and upwardly extending channel gripping member 60, the lower end 62 of which is integral with or secured to the rear surface 14 of the body panel 15 at a point 64 adjacent or at its lower edge 18. From the point of engagement 64 with the rear surface 14 of the body panel 15, the channel gripping member 60 comprises an upwardly and rearwardly extending leg member 66 with an offset foot element 68 at its distal end, the apex 67 between the leg member 66 and the foot element 68 being biased into engagement with the rear surface 50*a* or 50*b* of the central portion 46*a* or 46*b* of the channel member 45*a* or 45*b* in use, as will be seen in FIGS. 4 and 5, respectively.

The upper end 72 of a downwardly depending lower flange engaging member 70 is integral with or secured to the rear surface 14 of the body panel 15 at a point 74 spaced above the point 64 at which the channel gripping member 60 is secured. From the point of engagement 74 with the rear surface 14 of the body panel 15, the lower flange engaging member 70 comprises a rearwardly and downwardly extending finger 76, having a distal end 78 biased into engagement with the upper surface of the lower flange member or lip 58*a* or 58*b* of the channel member 45*a* or 45*b*.

An upper flange engaging finger member 85 is integral with or otherwise secured to the upper edge 16 of the body panel 15 by an upwardly and rearwardly angled collapsible biasing member 86. The distal end 88 of the finger 85 engages against the lower surface of the upper flange or lip 54*a* or 54*b* of the channel member 45*a* or 45*b* in use and fills any space between the label holder back panel 15 and the upper and lower flanges of the channel member. Because of the opaque nature of the body panel 15 and the integral finger 85, the area behind the label holder 10 is hidden from view, covering any unsightly residue of adhesive labels previously secured to the channel member and precluding dirt from getting behind the label holder 10 when it is engaged with the channel member.

Figure 4:
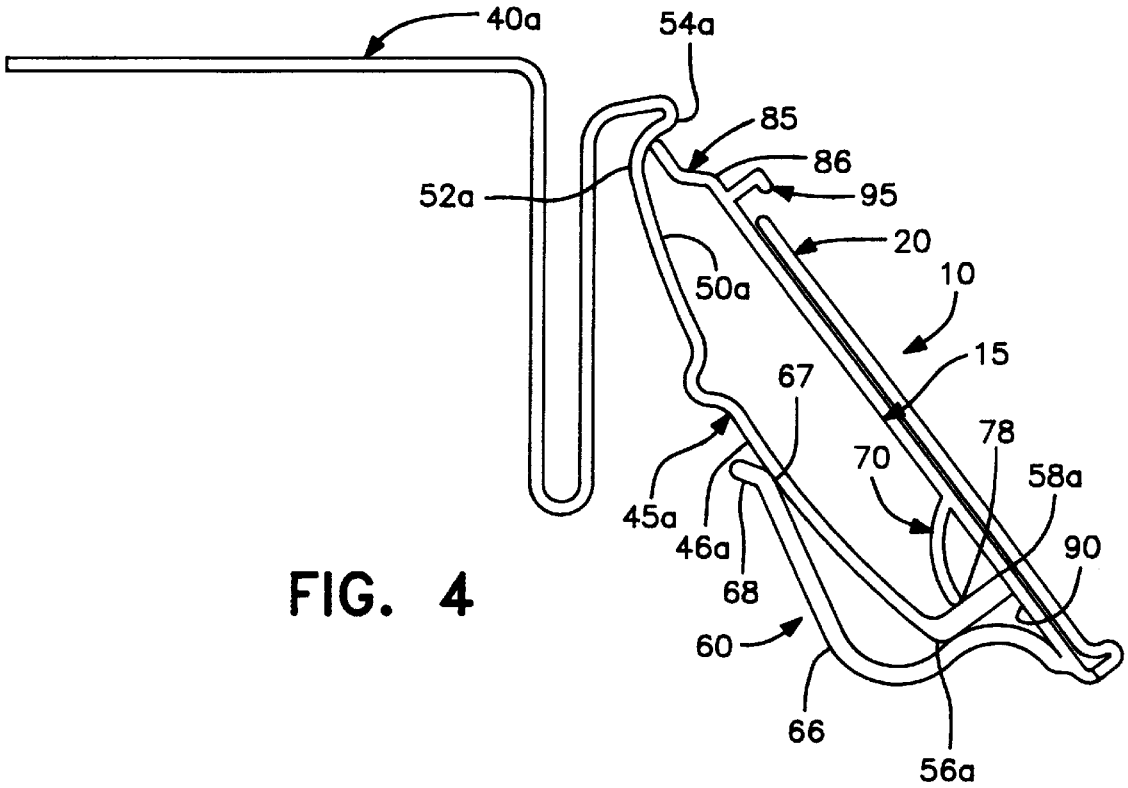
FIG. 4 is an enlarged side elevational view further illustrating the manner in which the label holder of FIG. 1 is attached to the channel member on the front edge of a Streator-type merchandise shelf.
Figure 5:
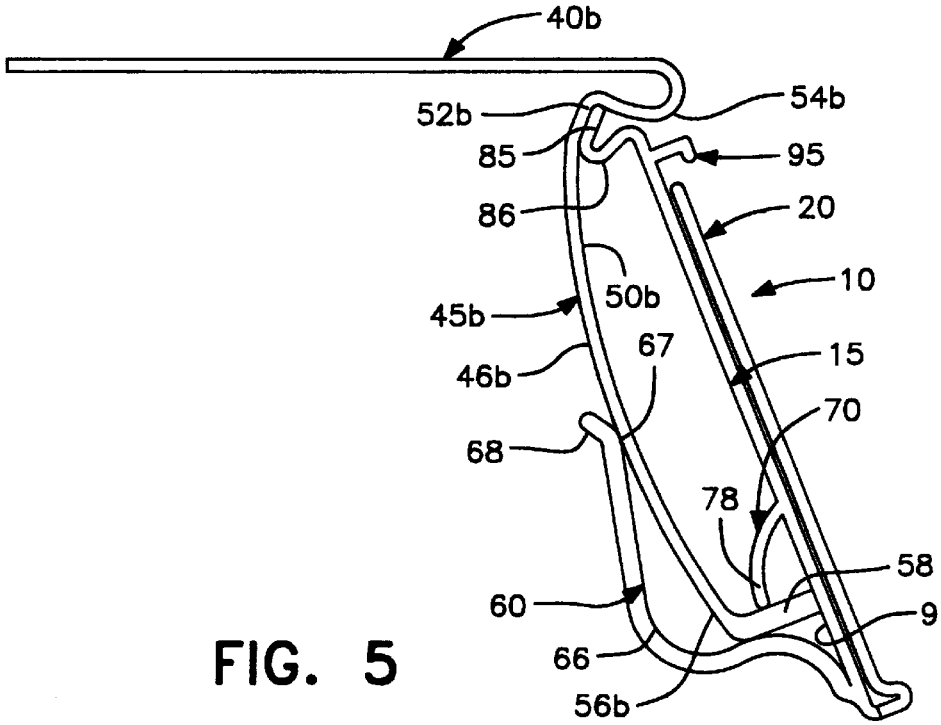
FIG. 5 is a view like FIG. 4, but illustrating the manner in which the holder of FIG. 1 is secured within the C-channel of a Lozier-type merchandise shelf.

It will be seen that the body panel 15 of the label holder 10 is dimensioned to more than span the space between the upper flanges 54*a* or 54*b* and the lower flanges 58*a* or 58*b* of the channel member 45*a* or 45*b* in both the Streator and Lozier shelves 40*a*, 40*b*. Preferably, the portion 90 of the rear surface 14 of the body panel 15 between the points 64 and 74 at which the lower end 62 of the channel gripping member 60 and the upper end 72 of the finger 70 are secured is dimensioned to receive the lower flange 58*a* or 58*b* of the channel member 45*a* or 45*b*. As seen in FIGS. 4 and 5, the portion 90 of the rear surface 14 of the body panel 15 may rest against the forward portion of the lower flange 58*a* or 58*b* of the channel member 45*a* or 45*b* with the distal or terminal end 78 of the finger 70 engaged against the upper surface of the lower flange member 58*a* or 58*b* of the channel member 45*a* or 45*b* in use to assist in positioning the label holder 10 on the channel member.

Of particular importance to the unique versatility of the label holder 10 of this invention is the interaction between the engagement of the channel gripping member 60 and the finger 70 with the lower portions of a merchandise shelf channel member, particularly the engagement of the finger 70 with the upper surface of the lower flange 58*a* or 58*b*, regardless of its construction, and the engagement of the finger 85 with the lower surface of the upper flange 54*a* or 54*b*, regardless of the spacing between the flanges or their configuration. The flexibility of the fingers 70, 85 exert opposing tension against the distal ends of these elements to securely hold the label holder within the channel member, even when the flanges 54*a*, 54*b* are somewhat more widely spaced and less reverted as in the Streator-type shelf 40*a* of FIG. 4. In such use, the interengagement of these elements is sufficient to preclude accidental disengagement of the label holder 10 from the channel member 45*a* even when the cover 20 is bent outwardly from the body panel 15 for insertion and removal of a paper or plastic label 25 as shown in FIG. 6, or reverted flange portions 27 of a sign or sign holder 29 as shown in FIG. 7.

Yet, the ability of the finger 85 to readily bend downwardly and backwardly about the angled portion 86 as seen in FIG. 5 enables the label holder 10 of this invention to be easily engaged between, and removed from, the more closely spaced and pronounced flanges or lips 54*b*, 56*b* of the channel member 45*b* of a Lozier-type shelf 40*b*.

The use and application of the device of the instant invention will be readily understood by those skilled in the art. At a point where it is desired to display an information-containing non-adhesive label or sign, a holder 10 can simply be slid over the bottom of the channel member 45, with the distal end 78 of the lower finger member 70 engaging the upper surface of the lower flange 54, the channel gripping member 60 snapped behind the channel member 45 and the distal end 88 of the finger 85 engaging the lower surface of the upper flange 54. The finger 85 will either be extended to fill the space between the flanges 54*a*, 58*a* of a Streator-type shelf 40*a*, or collapsed to accommodate the shorter spacing between the flanges 54*b*, 58*b* of a Lozier-type shelf 40*b*. In this manner, the label holder 10 is removably secured to the channel member 45 at any desired position, may be slid sideways to reposition the same, or readily removed entirely for re-use elsewhere without the need for extraneous tools.

Figure 6:
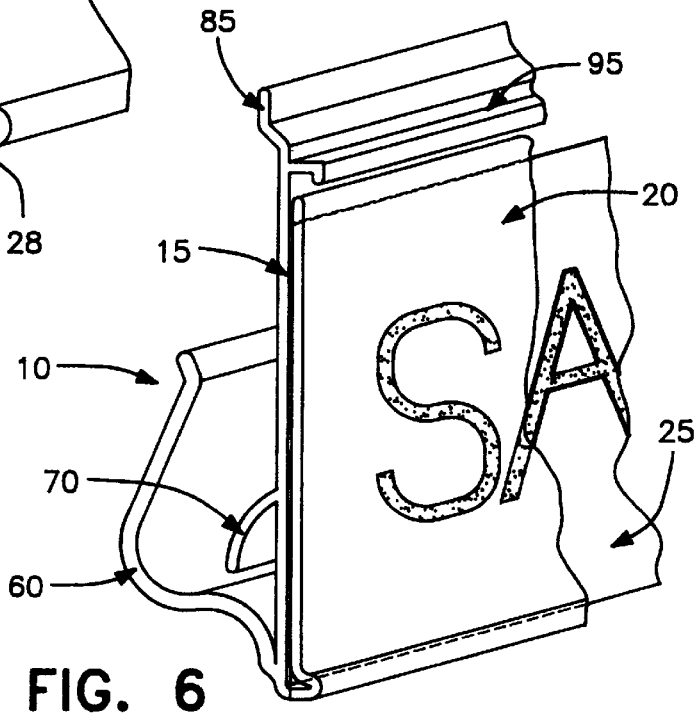
FIG. 6 is a fragmentary perspective view similar to FIG. 1, but showing a non-adhesive label engaged in the pocket behind the transparent cover of the label holder.
Figure 7:
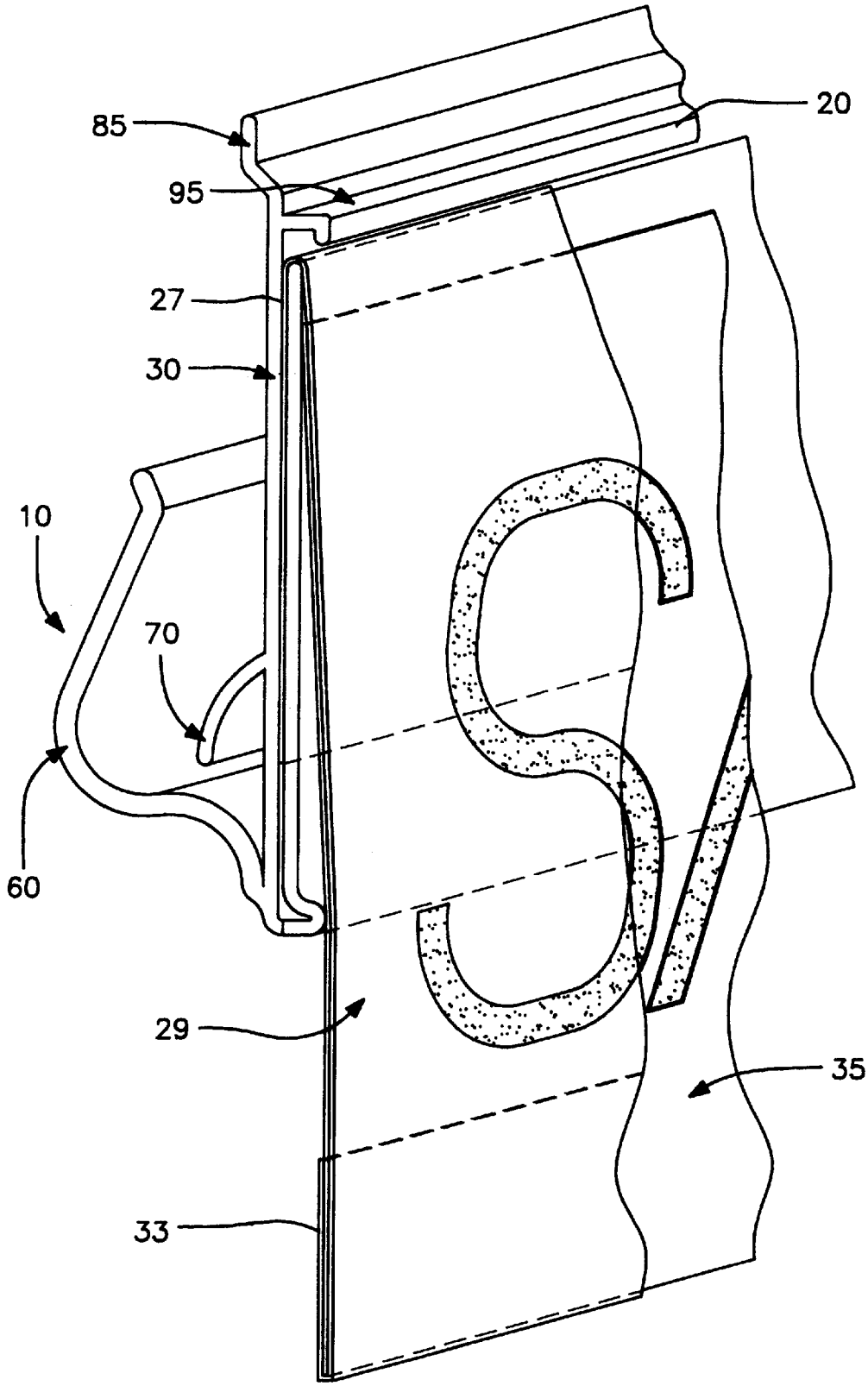
FIG. 7 is a similar view, but illustrating the engagement of an enlarged plastic sign or sign holder in the label holder of this invention.

Non-adhesive labels or signs 25 can be inserted into the pocket 30 as seen in FIG. 6 and replaced at will. Visual and electronic viewing of the information carried on such labels through the transparent cover 20 is readily effected, while the front surface of the channel member is visually hidden by the opaque body panel 15 and protected by the label holder 10.

A forwardly extending ledge or lip 95 with a downwardly extending flange 96 at its distal end may be provided on the front surface 12 of the body panel 15 of the label holder 10 of this invention to overlie the upper edge 26 of the cover 20 and thereby protect the pocket 30 against entry of dirt or any liquid dripping from above. The lip 95 also would act as a catch for sign holder 29, thus preventing the sign holder from dislodging from the price channel. See FIG. 7 discussed below.

The holder 10 is also adapted to support an enlarged sign or sign holder such as shown at 29 in FIG. 7. Such products are described in detail in U.S. Pat. No. 5,682,698 issued Nov. 4, 1997, the subject matter of which is incorporated herein in its entirety by reference. The sign holder 29 has reverted flaps or flanges 27, 33 of different dimensions and is thereby adapted to be directly engaged in merchandise shelf C-channels of different heights. In this instance, one of the flanges shown as 27 in FIG. 7, is actually engaged behind the cover 20 of the holder 10. Information can be printed directly on the sign holder 29, or a non-adhesive label such as shown at 35 may be slid between the flanges 27, 33 as illustrated in FIG. 7.

While only preferred embodiments of the invention have been described herein in detail, the invention is not limited thereby and modifications can be made within the scope of the attached claims.

We claim:

1. In combination, a merchandise shelf having a shelf channel member defined at its front edge, said shelf channel member including an elongated central portion having front and rear surfaces and upper and lower edges defining forwardly extending upper and lower flanges, respectively, said upper flange having a downwardly facing lower surface and said lower flange having an upwardly facing upper surface, and a label holder for displaying information-containing labels or the like mounted on said shelf channel member, said label holder comprising a generally planar body panel having front and rear surfaces and upper and lower ends, means receiving and removably retaining a label or the like in contact with said front surface of said body panel, a channel gripping member having a lower end connected to said rear surface of said body panel at a point adjacent said lower end thereof, said channel gripping member including an upwardly and rearwardly extending leg member terminating in a free upper end portion, said end portion of said channel gripping leg member being biased toward and engaging said rear surface of said shelf channel member, a lower channel flange engaging member having an upper end connected to said rear surface of said body panel at a position spaced above the point at which said lower end of said channel gripping member is connected to said rear surface of said body panel, said lower channel flange engaging member including a downwardly and rearwardly extending finger terminating in a free lower end portion, said end portion of said lower channel flange engaging finger being biased toward and engaging said upper surface of said lower flange of said shelf channel member, and an upper channel flange engaging member having a lower end connected to the upper end of said body panel by a collapsible biasing element, said upper channel flange engaging member including a finger terminating in a free upper end portion, said end portion of said upper channel flange engaging finger being biased toward and engaging said lower surface of said upper flange of said shelf channel member, and said upper channel flange engaging member being collapsible about said collapsible biasing element to accommodate shelf channel members of reduced dimension between their upper and lower flanges.

2. The combination of claim 1 wherein said collapsible biasing element includes an angled member having a lower end and an upper end, said lower end of said angled member being connected to said upper end of said body panel and said upper end of said angled member being connected to said lower end of said upper channel flange engaging finger, said angled member extending upwardly and rearwardly from said upper end of said body panel and being pivotable downwardly and rearwardly when pressure is exerted against said free upper end portion of said upper channel flange engaging finger.

3. The combination of claim 1, further including a forwardly and downwardly extending ledge member connected to said front surface of said body panel adjacent said upper end of said body panel, said ledge member overlying and protecting a label carried by said label receiving means.

4. The combination of claim 1 wherein said body panel and said upper channel flange engaging member together span the space between said upper and lower flanges of said shelf channel member.

5. The combination of claim 4 wherein, at least the portions of said label holder spanning the space between said upper and lower flanges of said shelf channel member are opaque.

6. The combination of claim 1 wherein said means receiving and removably retaining a label comprises a generally planar transparent cover having front and rear surfaces and upper and lower edges, said lower edges of said cover being flexibly connected to said lower end of said body panel to define a pocket between said front surface of said body panel and said rear surface of said cover, a label being removably received in said pocket.

7. The combination of claim 6 wherein said label holder is a co-extrusion of an opaque plastic material forming said body panel and a transparent plastic material forming said cover.

* * * * *